US007479594B2

(12) United States Patent
Matsuura et al.

(10) Patent No.: US 7,479,594 B2
(45) **Date of Patent: *Jan. 20, 2009**

(54) SOUND DATA ENCODING APPARATUS AND SOUND DECODING APPARATUS

(75) Inventors: Hiromitsu Matsuura, Tokyo (JP); Takehiro Tominaga, Tokyo (JP)

(73) Assignee: Sony Computer Entertainment Inc., Tokyo (JP)

( * ) Notice: Subject to any disclaimer, the term of this patent is extended or adjusted under 35 U.S.C. 154(b) by 326 days.

This patent is subject to a terminal disclaimer.

(21) Appl. No.: 11/284,426

(22) Filed: Nov. 21, 2005

(65) Prior Publication Data

US 2006/0107821 A1 May 25, 2006

(30) Foreign Application Priority Data

Nov. 25, 2004 (JP) ..... 2004-339955

(51) Int. Cl.
*G10H 7/02* (2006.01)

(52) U.S. Cl. ..... 84/603; 84/602; 84/607; 700/94; 704/500

(58) Field of Classification Search ..... 84/600–607; 704/500; 700/94
See application file for complete search history.

(56) References Cited

U.S. PATENT DOCUMENTS 5,086,475 A * 2/1992 Kutaragi et al. ..... 704/265
2007/0116301 A1* 5/2007 Suzuki ..... 381/106

FOREIGN PATENT DOCUMENTS

JP 8-287612 11/1996
JP 11-282465 10/1999

OTHER PUBLICATIONS

Notification of Reason(s) for Refusal, dated Nov. 11, 2008, for the corresponding Japanese Patent Application JP 2004-339955.

* cited by examiner

*Primary Examiner*—David S. Warren
(74) *Attorney, Agent, or Firm*—Katten Muchin Rosenman LLP

(57) ABSTRACT

Tone quality is improved at the time of playing back sound data having a loop part.

A sound data encoding apparatus encodes sound data in groups of a plurality of consecutive blocks. In the case where the sound start position is equal to the loop start position, encoding is performed using samples of sound data (for example, sound data just before the loop end) relating to the sound data at the sound start position from the viewpoint of music. In the case where the sound end position is equal to the loop end position, encoding is performed using samples of sound data (for example, sound data just after the loop start) relating to the sound data at the sound end position from the viewpoint of music.

12 Claims, 12 Drawing Sheets

SOUND DATA ENCODING APPARATUS AND SOUND DECODING APPARATUS

BACKGROUND OF THE INVENTION

The present invention relates to recording and playing of sound data, and particularly to a recording and play technique that reduces a processing load at the time of playing back sound data having a loop part.

In an information processing apparatus having a digital sound data play function, such as a personal computer, a game machine, a music play apparatus or the like, coded sound data are converted into analog sound data before sound output at the time of playing.

Some coded sound data, such as data of a music CD, are non-compressed. However, in many cases, sound data are read in a compressed state, and at the time of playing, expanded and outputted as sound.

Various sound compression methods have been proposed and practically used. Widely known is a method in which time series sample data are divided into a plurality of blocks, and an orthogonal transform such as DCT (Discrete Cosine Transform) or MDCT (Modified Discrete Cosine Transform) is applied to those blocks to obtain compressed data. In that case, to increase continuity of sound waveforms, compression is sequentially performed in groups of adjacent blocks, while making each group overlap with the next one in a block. As a representative of such compression methods, may be mentioned ATRAC (Adaptive TRans form Acoustic Coding) employed by a so-called mini disc (MD) and the like (See Patent Document 1).

FIG. 3 is a diagram showing compression of sound data in blocks. In the figure, time series sample data are divided into blocks (original blocks) A, B, C, D, E, . . . , each consisting of predetermined pieces of data.

Then, compression is performed in groups of two consecutive blocks, with each group overlapping the next group in one block, to generate encoded blocks. Here, no sound data exists before the start position (DS) of the sound data, and accordingly, there is no block to be paired with the block A. Thus, a block A0 consisting of dummy data such as silence data is added to be paired with the block A. Similarly, no sound data exists after the end position (not shown) of the sound data, and accordingly, there is no block to be paired with the last block. Thus, a block consisting of dummy data such as silence data is added to be paired with the last block.

Then, in this example, encoded data X1 are generated from the original blocks A0 and A, and encoded data X2 from the original blocks A and B.

At the time of playing the sound data, a decoded block a is generated from the encoded blocks X1 and X2. Then, the samples of the decoded block a are subjected to D/A conversion to reproduce the sound. In the same way, decoded blocks b, c, . . . can be obtained, and thus, the sound is reproduced continuously. Here, FIG. 3(*d*) shows the decoded blocks in the case where audio codec delay occurs at the time of encoding and decoding. As shown in the figure, output positions of the decoded data are shifted by the size of the audio codec delay.

Patent Document 1: Japanese Non-examined Patent Laid-Open No. 8-287612

Sometimes, sound data include a loop part (a repeat part). For example, as shown in FIG. 3(*a*), there is a case where sound ranging from a prescribed position (LS) to another prescribed position (LE) of sample data is repeated until a certain condition is satisfied. Here, it is assumed that the start position LS of the loop is included in the original block A and the end position LE of the loop is included in the original block D.

At the time of playing in that case, as shown in FIG. 4, when playing is performed down to the position corresponding to LE in the decoded block d, then, playing is performed from the position corresponding to LS in the decoded block a. Here, FIG. 4 shows the decoded blocks in the case where audio codec delay occurs at the time of encoding and decoding. As shown in the figure, output positions are shifted backward by the size of the audio codec delay.

Conventionally, sound data having a loop part are played as described above. However, when such a method is employed, sometimes sound is disturbed at the loop part.

Thus, an object of the present invention is to improve tone quality at the time of playing sound data having a loop part.

SUMMARY OF THE INVENTION

To solve the above problem, a first mode of the present invention provides a sound data encoding apparatus for encoding sound data, wherein: the sound data encoding apparatus comprises: a block dividing means that divides the sound data into blocks; and an encoding means that encodes the blocks in groups of a plurality of consecutive blocks; and, in the case where a loop start position and a loop end position are designated with respect to the sound data and the loop start position is a sound start position, then the encoding means encodes the blocks, using sound data samples just before the loop end position as sound data samples before the sound start position.

Further, a second mode of the present invention provides a sound data encoding apparatus for encoding sound data, wherein: the sound data encoding apparatus comprises: a block dividing means that divides the sound data into blocks; and an encoding means that encodes the blocks in groups of a plurality of consecutive blocks; and, in the case where a loop start position and a loop end position are designated with respect to the sound data and the loop end position is a sound end position, then the encoding means encodes the blocks, using sound data samples just after the loop start position as sound data samples after the sound end position.

Further, a third mode of the present invention provides a sound encoding apparatus for encoding sound data, wherein: the sound data encoding apparatus comprises: a block dividing means that divides the sound data into blocks; and an encoding means that encodes the blocks in groups of a plurality of consecutive blocks; and, in the case where a part between a sound start position and a sound end position is a loop part of the sound data, then the encoding means encodes the blocks, using sound data samples just before the sound end position as sound data samples just before the sound start position, and sound data samples just after the sound start position as sound data samples just after the sound end position.

Further, a fourth mode of the present invention provides a sound data decoding apparatus that sequentially reads encoded sound data encoded by the above-described sound data encoding apparatus, and decodes the encoded sound data in groups of a plurality of consecutive blocks.

At the time of outputting the decoded data, the above-described sound data decoding apparatus may cut output of data before the loop start position in a block including the loop start position, or may cut output of data after the loop end position in a block including the loop end position.

Further, in the case where the loop start position coincides with the sound start position, when the above-described sound data decoding apparatus has decoded the block including the loop start position, the sound data decoding apparatus may output data corresponding to data located on and before the loop end position, before outputting data corresponding to data at the loop start position.

Further, in the case where the loop end position coincides with the sound end position, when the above-described sound data decoding apparatus has decoded the block including the loop end position, the sound data decoding apparatus may output data corresponding to data located on and after the loop start position, after outputting data corresponding to data at the loop end position. For example, when the sound data decoding apparatus has decoded the block including the loop end position, the sound data decoding apparatus may output data corresponding to data located on and after the loop start position, following the data corresponding to the data at the loop end position. As a result, it is possible to increase the number of output samples of the block including the loop end position, and thus more time is permitted before it is required to output the next block decoded.

DETAILED DESCRIPTION

Figure 1:
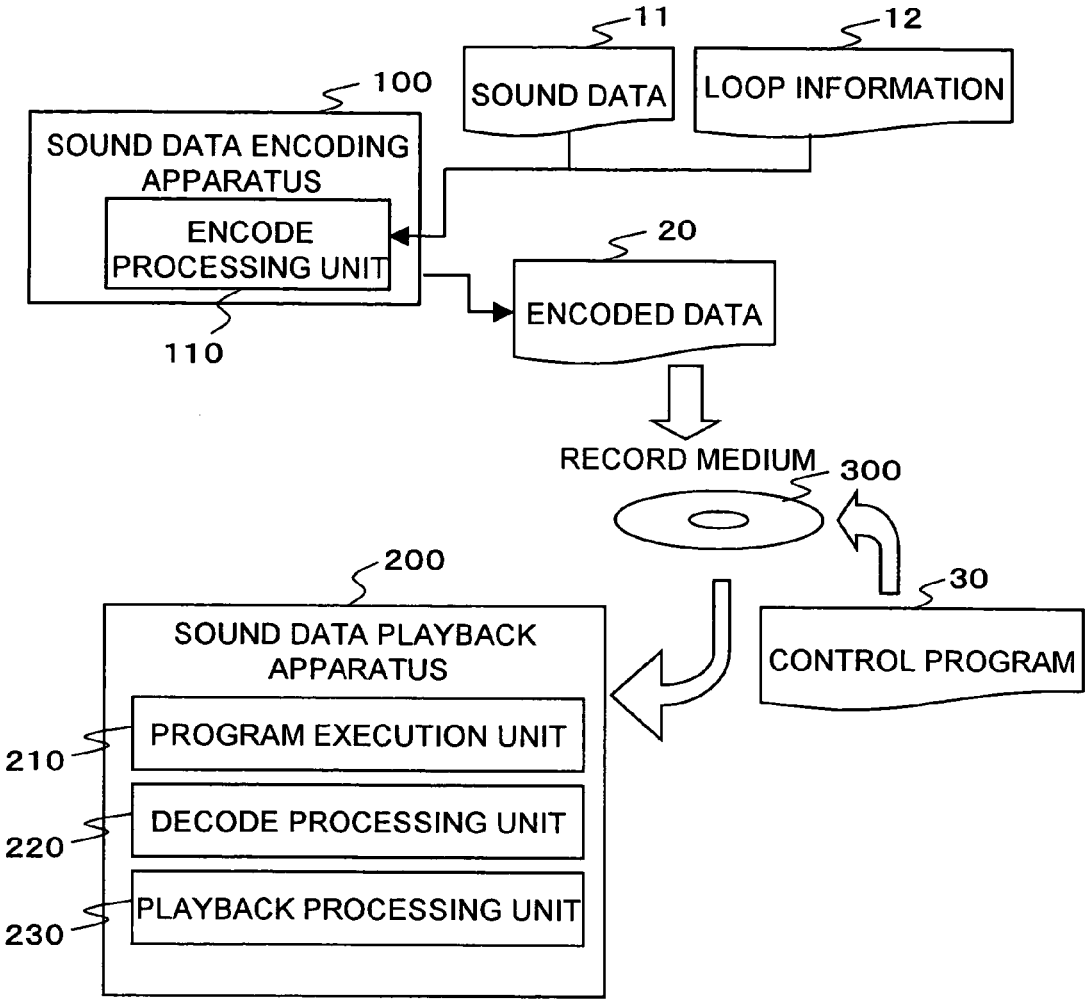
FIG. 1 is a diagram showing an outlined configuration of an embodiment of the present invention.

Embodiments of the present invention will be described referring to the drawings. FIG. 1 is a diagram showing an outlined configuration of an embodiment of the present invention. As shown in the figure, in the present embodiment, sound data encoded by a sound data encoding apparatus 100 are decoded and played by a sound data playback apparatus 200.

In detail, the sound data encoding apparatus 200 reads sound data 11 as a recorded object, performs processing such as compression using an encode processing unit 110 to convert the sound data 11 into encoded data 20. Here, it is assumed that the sound data 11 are data sampled previously at a predetermined rate. Of course, it is possible that analog sound data are inputted into the sound data encoding apparatus 100 and the sound data encoding apparatus 100 performs A/D conversion on the inputted analog sound data.

In the present embodiment, the sound data 11 includes a loop part, and the loop start position and the loop end position are designated in advance. The loop start position and loop end position are designated by addresses, sample numbers or the like in the sound data 11, and such addresses or the like are read as loop information 12 together with the sound data 11. The loop information 12 may be added to a header part of the sound data 11 or may exist separately from the sound data 11.

As for the loop part, at the time of playing of the sound data 11 in the sound data playback apparatus 200, existence or nonexistence of a loop is judged according to a certain condition.

When it is judged that looping should be executed as a result of the judgment on the existence or nonexistence of a loop, then looping is executed according to the loop information 12. Namely, playing is performed down to the loop end position, and then playing is continued by returning to the loop start position. On the other hand, when it is judged that looping should not be executed, then looping is not executed irrespective of the loop information 12. Namely, playing is performed down to the loop end position, and then playing of the sound data 11 following the loop end position is continued.

The developer can freely determine which part of the sound data 11 should be a loop part, based on the content of the sound data 11.

The encode processing unit 110 of the sound data encoding apparatus 100 divides the sound data 11 into a plurality of blocks. Then, taking a predetermined number of consecutive blocks as one unit, encoding is performed according to MDCT (Modified Discrete Cosine Transform) on each unit, which overlaps the next unit in a block, to generate encoded data successively. Details of the processing in the encode processing unit 110 will be described later.

The encoded data 20 are recorded together with a control program 30, which controls loop processing of the sound data 11, into a record medium 300 such as a CD-ROM. Record processing into a record medium 300 may be performed by the sound data encoding apparatus 100. Or another apparatus may perform the record processing.

Or, the encoded data 20 and the control program 30 may be recorded respectively into separate record media 300. Further, the record medium 300 is not limited to a CD-ROM, and may be used an optical disk such as a DVD-ROM, a magnetic disk, a semiconductor storage device, or the like. Or, it is possible that the sound data encoding apparatus 100 outputs the encoded data 20 to the sound data playback apparatus 200 through a communication line such as the Internet.

The control program 30 is a program executed in the sound data playback apparatus 200. According to the control program 30, the sound data playback apparatus 200 determines a method of playing back the encoded data 20, for example, in response to operation by a user. For example, a loop part is played repeatedly until a certain operation such as a key input is received from a user. And, when the certain operation is received, the playing of the loop part is ended and data following the loop part are played.

The sound data playback apparatus 200 comprises: a program execution unit 210 for executing the control program 30 and the like; a decode processing unit 220 for decoding the encoded data 20; and a playback processing unit 230 for sound-outputting the decoded sound data through a speaker. By this arrangement, the sound data playback apparatus 200 can decode and playing the encoded data 20 almost in real time. Detailed processing in the decode processing unit 220 will be described later.

Here, the sound data encoding apparatus 100 can be implemented by a personal computer, a workstation, or another general information processing apparatus, as far as it has a sound processing function. Of course, a dedicated system specialized in sound data recording may be used as the sound data encoding apparatus 100.

Also, the sound data playback apparatus 200 can be implemented by a personal computer, a workstation, or another general information processing apparatus, as far as it has a sound processing function. Of course, a dedicated system specialized in sound data playing may be used as the sound data playback apparatus 200.

The present invention can be applied more effectively to the case where, as the sound data playback apparatus 200, is used an information processing apparatus, such as a PDA (Personal Digital Assistant), a portable game machine, or a portable music player, whose processing speed is restricted due to its emphasis on portability.

An information processing apparatus can function as the sound data encoding apparatus 100 or the sound data playback apparatus 200 when an application program developed for sound data recording or sound data playing is executed by its central processing unit (CPU). These application programs may be circulated in the market, being recorded on a record medium such as a CD-ROM or the like. Or, these programs may be circulated through a computer network such as the Internet.

Figure 2:
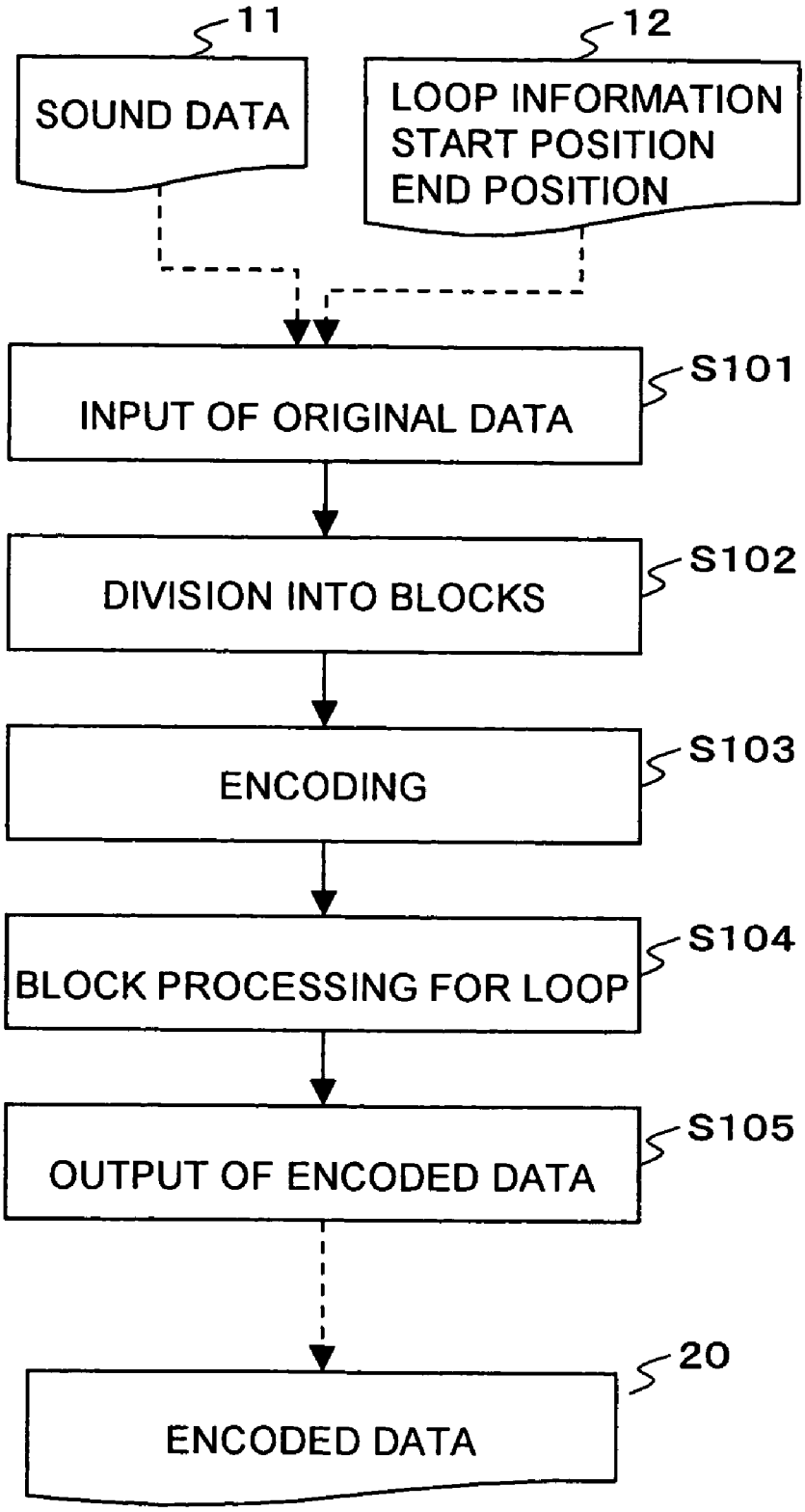
FIG. 2 is a flowchart for explaining encode processing in a sound data encoding apparatus 100.

Next, referring to a flowchart of FIG. 2, will be described the processing of encoding sound data in the sound data encoding apparatus 100.

First, the sound data encoding apparatus 100 reads sound data 11 and loop information 12 as original data (S101). Here, the sound data 11 are time series sample data as shown in FIG. 3(*a*), and the loop information 12 designates a loop start (LS) position and a loop end (LE) position in the sound data 11.

Next, the encode processing unit 110 divides the sound data 11 into blocks (S102).

Figure 3:
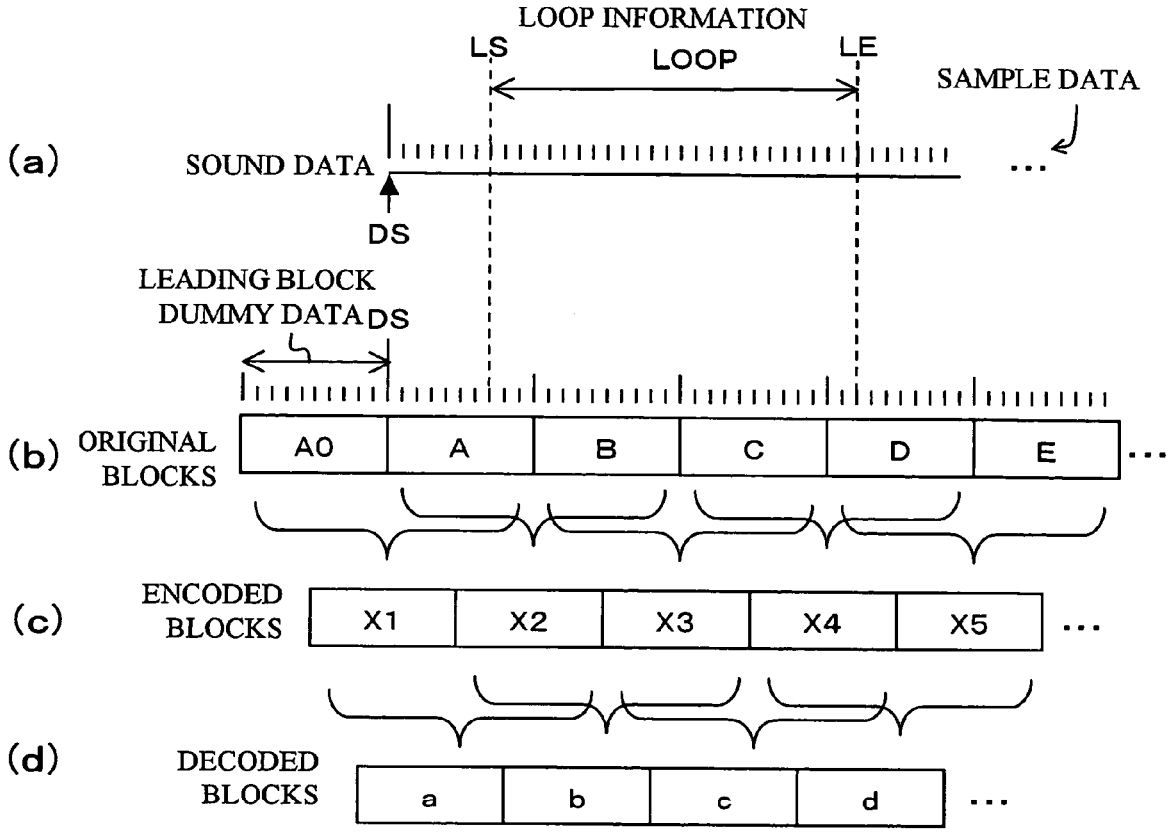
FIG. 3 is a diagram for explaining a method of dividing blocks of sound data 11.
Figure 4:
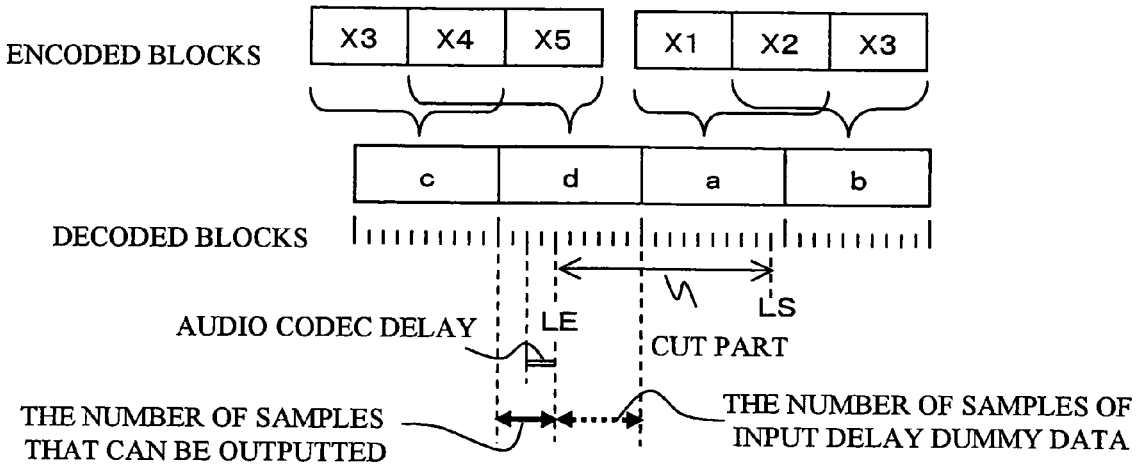
FIG. 4 is a diagram for explaining processing in blocks at the time of looping.

Conventionally, as shown in FIG. 3(*b*), the sound data 11 are divided sequentially, beginning at the sound data start position (DS). As a result, as shown in FIG. 4, in the block d that includes the loop end position of the decoded data, the loop end position does not necessarily come in the last part (for example, the end) of the block.

Figure 5:
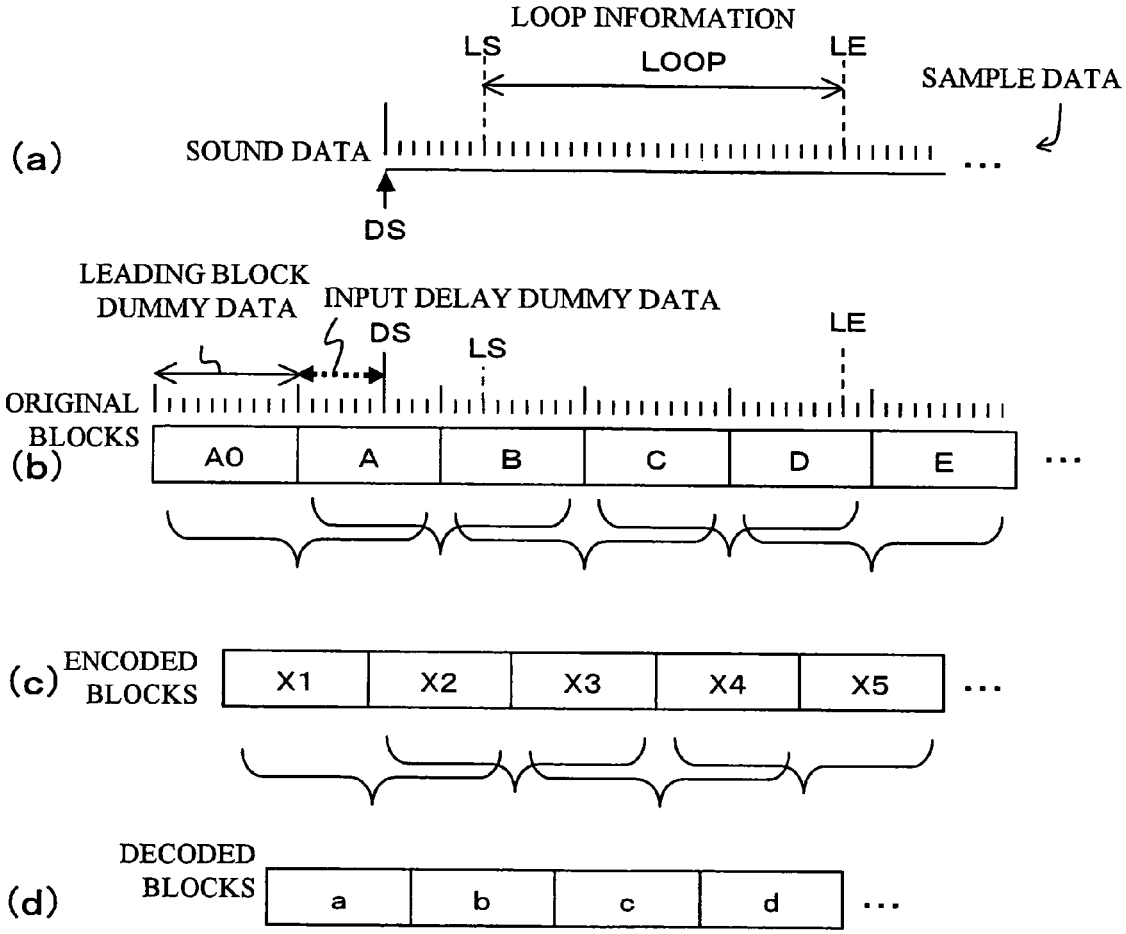
FIG. 5 is a diagram for explaining a method of dividing blocks of the sound data 11.
Figure 7:
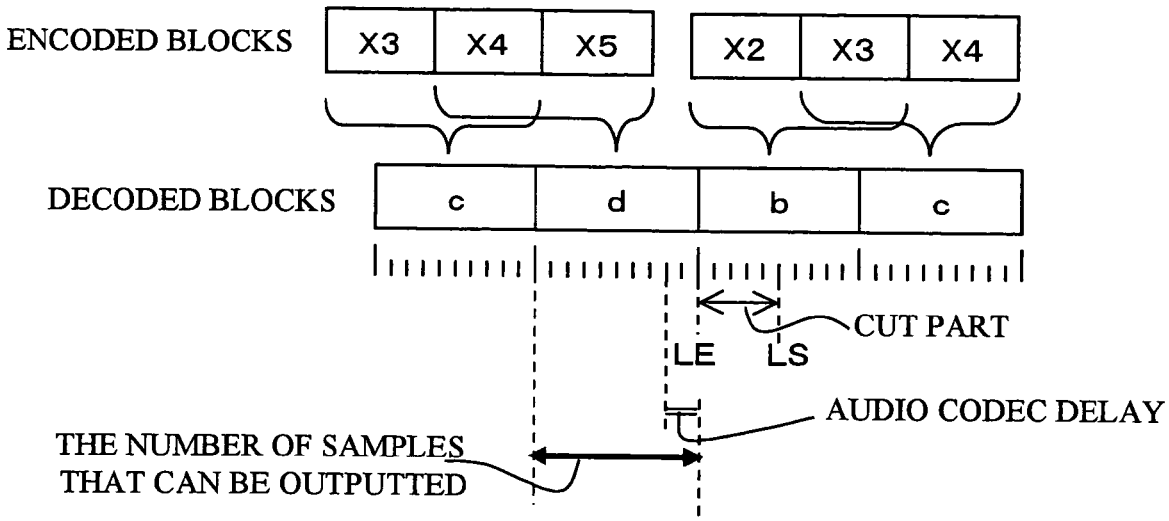
FIG. 7 is a diagram for explaining processing in blocks at the time of looping.

On the other hand, in the present embodiment, as shown in FIG. 5(*b*), input delay dummy data are added ahead of the sound data, before dividing the sound data. As a result, as shown in FIG. 7, in the block d that includes the loop end position of the decoded data, the loop end position is made to come in the last part (for example, the end) of the block.

In detail, the encode processing unit 110 tentatively divides the sound data 11 into groups of a predetermined number of samples from the top as in the conventional case as shown in FIG. 3(*b*). When the thus-divided sound data 11 are encoded and further decoded, blocks of decoded data are obtained as shown in FIG. 4. Here, with respect to the block d that includes the loop end position, the encode processing unit 110 obtains the number of samples after the loop end position up to the end of the block. The obtained number of samples becomes the number of samples of the input delay dummy data.

Next, as shown in FIG. 5(*b*), dummy data (for example, silence data), whose number equals the obtained input delay dummy data sample number, are added ahead of the sound data 11.

Here, will be described the case where the number of samples in one block is L. It is assumed that, when the original sound data are divided starting from the top, the loop end position becomes the X-th sample ($1<=X<=L$) in the block including the loop end position. In that case, to make the loop end position become the L-th sample (the end of the block) in the block in question of the decoded data, the number of samples of the input delay dummy data to be added is $L-X$.

However, in the case where audio codec delay occurs, then assuming that the number of samples corresponding to encoding delay is ED and the number of samples corresponding to decoding delay is DD, the number of samples of the input delay dummy data to be added is $L-1-(X-1+ED+DD)\ \%\ L$ (where % means residue arithmetic).

Here, the number of samples of the audio codec delay (ED and DD) is stored in advance in a storage unit of the sound data encoding apparatus 100.

Next, the encode processing unit 110 adds a block A0 ahead of the sound data 11, to pair with the block A at the time of encoding. The block A0 is a block of dummy data (hereinafter, referred to as leading block dummy data). The leading block dummy data are silence data, for example.

FIG. 5(*b*) shows that the sound data 11 are added with the input delay dummy data and the leading block dummy data, and thereafter, divided into blocks (original blocks). In the shown example, the start position (DS) of the sound data 11 is included in the original block A. The loop start position is included in the original block B. And, the loop end position is included in the original block D.

Although it is assumed here that the number of samples of each block is constant, that number may vary according to given rules.

Next, the encode processing unit 110 performs sound compression (encoding) in units of consecutive original blocks (S103). Here, regardless of existence or nonexistence of the loop information, encode processing is performed for each of the original blocks arranged in time series.

In this example, in the encode processing, two consecutive original blocks generate one encoded block. Each pair of consecutive blocks overlaps with the next pair in one block, and thus each original block is used twice for generating an encoded block and then for generating the next encoded block.

Namely, as shown in FIG. 5(*c*), the consecutive original blocks A0 and A generate an encoded block X1, and the original blocks A and B generate an encoded block X2. Then, in the same way, encoded blocks X3, X4, X5, . . . are generated.

As such a compression method, a representative one is ATRAC (Adaptive Trans form Acoustic Coding). However, the present invention is not limited to this. Further, it may be arranged that three consecutive original blocks generate one encoded block.

Next, the sound data encoding apparatus 100 outputs the time series encoded blocks as encoded data 20 (S105). At that time, loop information is generated as additional information to the encoded data 20, and outputted together with the encoded data 20.

The loop information includes information that can specify the sound data start position, the sound data end position, the loop start position and the loop end position in decoded data outputted by decoding the encoded data.

Or, for example, the loop information may include information of these positions themselves, i.e., the sound data start position, the sound data end position, the loop start position and the loop end position in the decoded data outputted by decoding the encoded data.

Or, the loop information may include the sound data start position, the sound data end position, the loop start position and the loop end position in the original sound data. In that case, to be able to specify these positions in the decoded data, the loop information further includes the number of samples of the input delay dummy data, the number of samples corresponding to the encoding delay and the number of samples corresponding to the decoding delay. Here, the number of samples of the input delay dummy data, the number of samples corresponding to the encoding delay and the number of samples corresponding to the decoding delay may be included separately, or the total number of samples obtained by adding up these numbers of samples may be included. In the case where the sound data playback apparatus 200 stores the number of samples corresponding to the encoding delay, it is not necessary that the loop information includes that number. Further, in the case where the sound data playback apparatus 200 stores the number of samples corresponding to the decoding delay, it is not necessary that the loop information includes that number.

As described above, the encoded data outputted by the sound data encoding apparatus 100 are recorded together with the control program 30 into a record medium 300 and circulated in the market.

Figure 6:
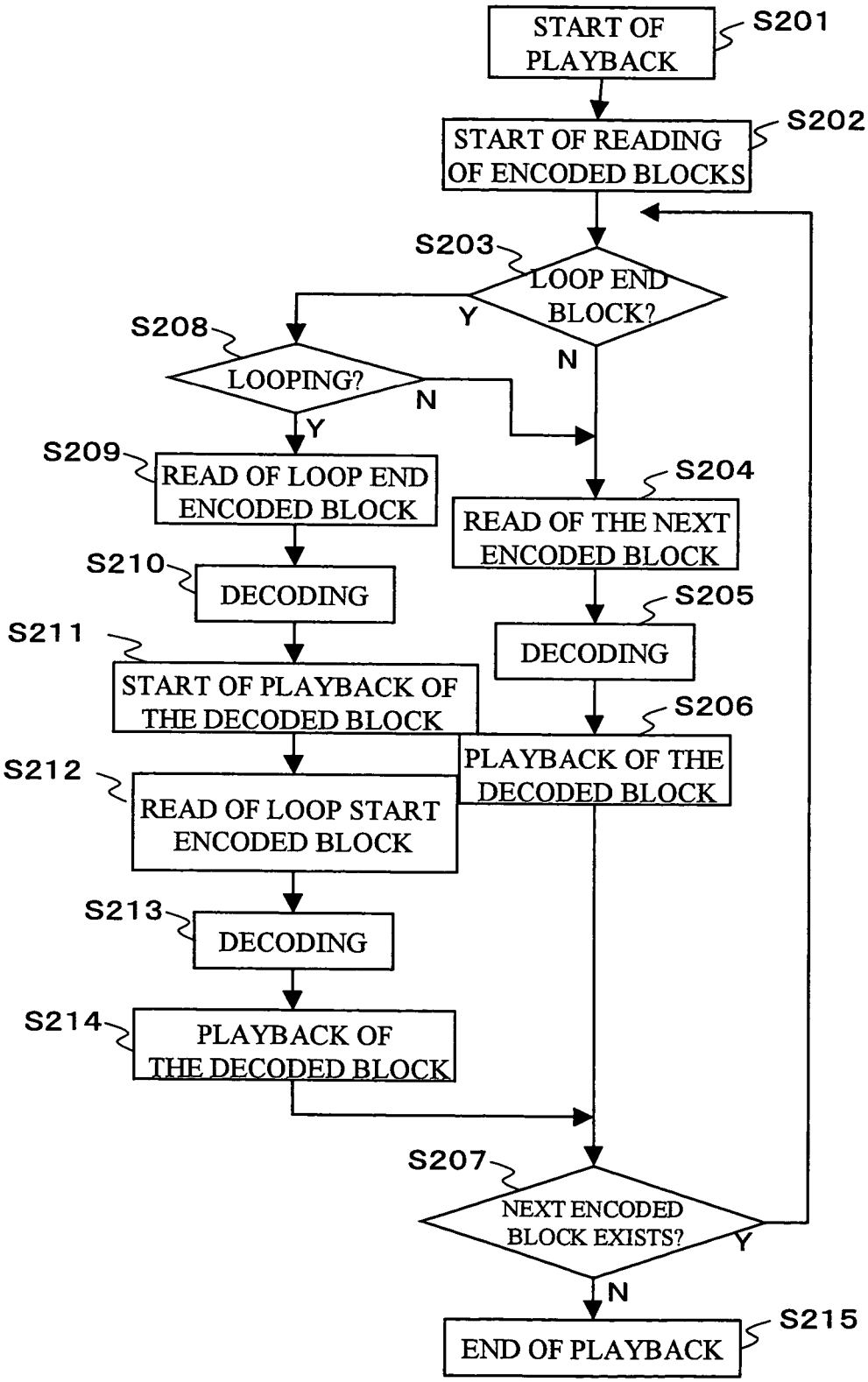
FIG. 6 is a flowchart for explaining play processing in a sound data playing apparatus 200.

Next, referring to a flowchart of FIG. 6, will be described playing processing in the sound data playback apparatus 200.

Based on the loop information, the sound data playback apparatus 200 identifies the sound data start position, the sound data end position, the loop start position and the loop end position in the decoded data. A method of identifying these positions is as follows.

For example, in the case where the loop information includes the information of those positions themselves, i.e., the sound data start position, the sound data end position, the loop start position and the loop end position in the decoded data, it is possible to identify those positions from the information.

Further, in the case where the loop information includes the information of the sound data start position, the sound data end position, the loop start position and the loop end position in the original sound data, then the loop information further includes the number of samples of the input delay dummy data, the number of samples corresponding to the encoding delay and the number of samples corresponding to the decoding delay. Or, the sound data playback apparatus 200 may store the number of samples corresponding to the encoding delay and/or the number of samples corresponding to the decoding delay. In these cases, it is possible to identify that the sound data start position, the sound data end position, the loop start position and the loop end position in the decoded data lie backward by the sum total of the number of samples of the input delay dummy data, the number of samples corresponding to the encoding delay and the number of samples corresponding to the decoding delay in comparison with the respective positions in the original sound data.

Now, will be described the flowchart of FIG. 6. This flow is started when a request for playing of the sound data recorded in a record medium is received as a result of user's operation or the like (S201).

First, the decode processing unit 220 reads the encoded block ahead of the encoded data 20 and the loop information (S202).

First, will be described playing in the case where the loop is not executed. Here, the case where the loop is not executed means the case where a block as an object of playing (a block after decoding; a decoded block) does not include the loop end position (S203: N), or the case where the block in question includes the loop end position (S203: Y) and yet the loop should not be executed (S208: N). Whether the loop is executed or not is judged by the program execution unit 210 according to the control program. Further, whether the decoded block includes the loop end position or not can be judged from the number of already-played blocks, the number of samples included in each block and the loop information.

In the case where the loop is not executed, the decode processing unit 220 reads the next encoded block as conventionally (S204), and performs decoding using the consecutive encoded blocks to generate a decoded block (S205).

Namely, as shown in FIG. 5(*d*), the encoded blocks X1 and X2 generate the decoded block a, and the encoded blocks X2 and X3 generate the decoded block b, and so on. The decoded blocks a, b, . . . are sound data corresponding to the original blocks A, B, . . . . However, in the case where audio codec delay occurs, it causes a shift by the number of samples corresponding to the audio codec delay.

The playback processing unit 230 plays back the sound data by sequentially performing D/A conversion of the decoded blocks, to output sound (S206). At the time of generating and playing back the decoded block that includes the sound data start position, the playback processing unit 230 cuts the input delay dummy data and the sample part corresponding to the audio codec delay, which are added ahead of the sound data 11, and plays back the decoded block from the sound data start position. Further, at the time of playing the decoded block that includes the sound data end position, the playback processing unit 230 plays back the decoded block up to the sample at the end position, and cuts the samples after the end position not to play those samples. The above-described processing is continued until the encoded blocks end (S207, S215).

Next, will be described playing in the case where the loop is executed. Here, the case where the loop is executed means the case where a decoded block as an object of playing includes the loop end position (S203: Y) and the loop should be executed (S208: Y).

In that case, the decode processing unit 220 reads the next encoded block. Referring to FIG. 7, will be described this case. Here, when an object of playing is the decoded block d, the repeat occurs. Since the encoded block X4 has been already read for processing the decoded block c, the encoded block X5 is read at this point (S209).

Then, the decode processing unit 220 generates the decoded block d from the blocs X4 and X5 (S210). And, the playback processing unit 230 starts playing of the decoded block d (S211).

Here, the playback processing unit 230 plays back the block d up to the sample at the loop end position, and cuts the samples after the loop end position not to play those samples. In the example shown in FIG. 7, the loop end position is at the end of the block d, and thus, the playback processing unit 230 plays back all the samples included in the block d.

After the generation of the decoded block d, the decode processing unit 220 immediately reads the encoded blocks X2 and X3 for obtaining the decoded block b that includes the loop start position (S212). Then, the decode processing unit 220 generates the decoded block b from the blocks X2 and X3 (S213). In FIG. 4, the block a includes the loop start position. However, in FIG. 5, the input delay dummy data are added to the sound data at the time of encoding, and thus, the block b includes the loop start position.

The playback processing unit 230 plays back the decoded block b. However, in the decoded block b, data to be played are sample data located after the loop start position. Accordingly, the playback processing unit 230 cuts the samples located before the loop start position, and plays back the sample data from the loop start position (S214). Here, as described above, the playback processing unit 230 judges the loop start position referring to the loop information.

Hereinabove, one embodiment of the present invention has been described. According to the above embodiment, in the blocks of the decoded data, the loop end position is located at the end of a block. Accordingly, the block at the loop end position includes sufficient data to be played (samples that can be outputted as sound). In other words, even in the case where the loop should be played, the sound data playback apparatus 200 can have a sufficient time for generating the decoded data at the loop start position. And thus, the processing load at the time of looping is reduced.

Further, according to the above embodiment, sometimes blocks relating to looping become smaller in number, and the processing load is reduced. For example, when the sound data are divided as shown in FIG. 3(*b*), then the decoded blocks relating to the loop part are four blocks, a, b, c and d as shown in FIG. 3(*d*). To obtain these decoded blocks, it is necessary to process five encoded blocks X1, X2, X3, X4 and X5. On the other hand, in the above embodiment, the input delay dummy data are added to the sound data before dividing the sound data as shown in FIG. 5(*b*). As a result, as shown in FIG. 5(*d*), the decoded blocks relating to the loop part becomes three blocks, b, c and d. To obtain these blocks, it is sufficient to process four encoded blocks X2, X3, X4 and X5.

The above embodiment can be modified variously.

For example, in the above embodiment, sound data are divided into blocks such that the loop end position is located at the end of a block. However, a method of dividing sound data is not limited to this. It is not necessary that the loop end position is located at the end of a block. It is sufficient that, as a result of division, the loop end position is located at least in the latter part of a block of the decoded data. Namely, it is sufficient that, when the sound data playback apparatus 200 processes the loop, a sufficient time can be ensured for decoding the block at the loop start position. In other words, it is sufficient that the block including the loop end position has sufficient data to be played (i.e., samples that can be outputted as sound). In the block at the loop end position, the number of samples to be played at the time of looping (loop end sample condition number) can be selected depending on the performance of the sound data playback apparatus 200.

The sound data encoding apparatus 100 stores in advance the loop end sample condition number in its storage unit, considering the performance of the sound data playback apparatus 200.

In detail, as shown in FIG. 3(*b*), the encode processing unit 110 tentatively divides the sound data 11 into blocks of a given number of samples, beginning ahead of the sound data 11.

Figure 8:
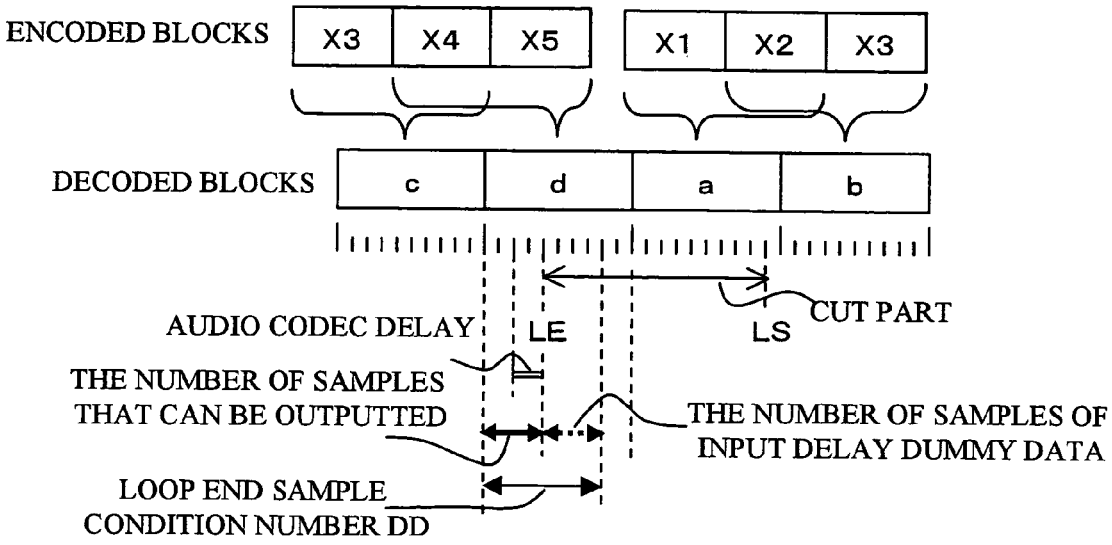
FIG. 8 is a diagram for explaining obtention of the number of samples of input delay dummy data in a variational example.

Thus-divided sound data 11 are encoded and then decoded to obtain blocks of the decoded data as shown in FIG. 8. Then, the encode processing unit 110 judges whether the number of samples up to the loop end position (the number of samples that can be outputted) in the block including the loop end position is larger than or equal to the loop end sample condition number. In the case where the number of samples that can be outputted is larger than or equal to the loop end sample condition number, the sound data 11 are divided and encoded without adding the input delay dummy data.

On the other hand, in the case where the number of samples up to the loop end position (the number of samples that can be outputted) is less than the loop end sample condition number, a difference between the loop end sample condition number and the number of samples that can be outputted as sound is obtained. The obtained difference is set as the number of samples of the input delay dummy data.

Figure 9:
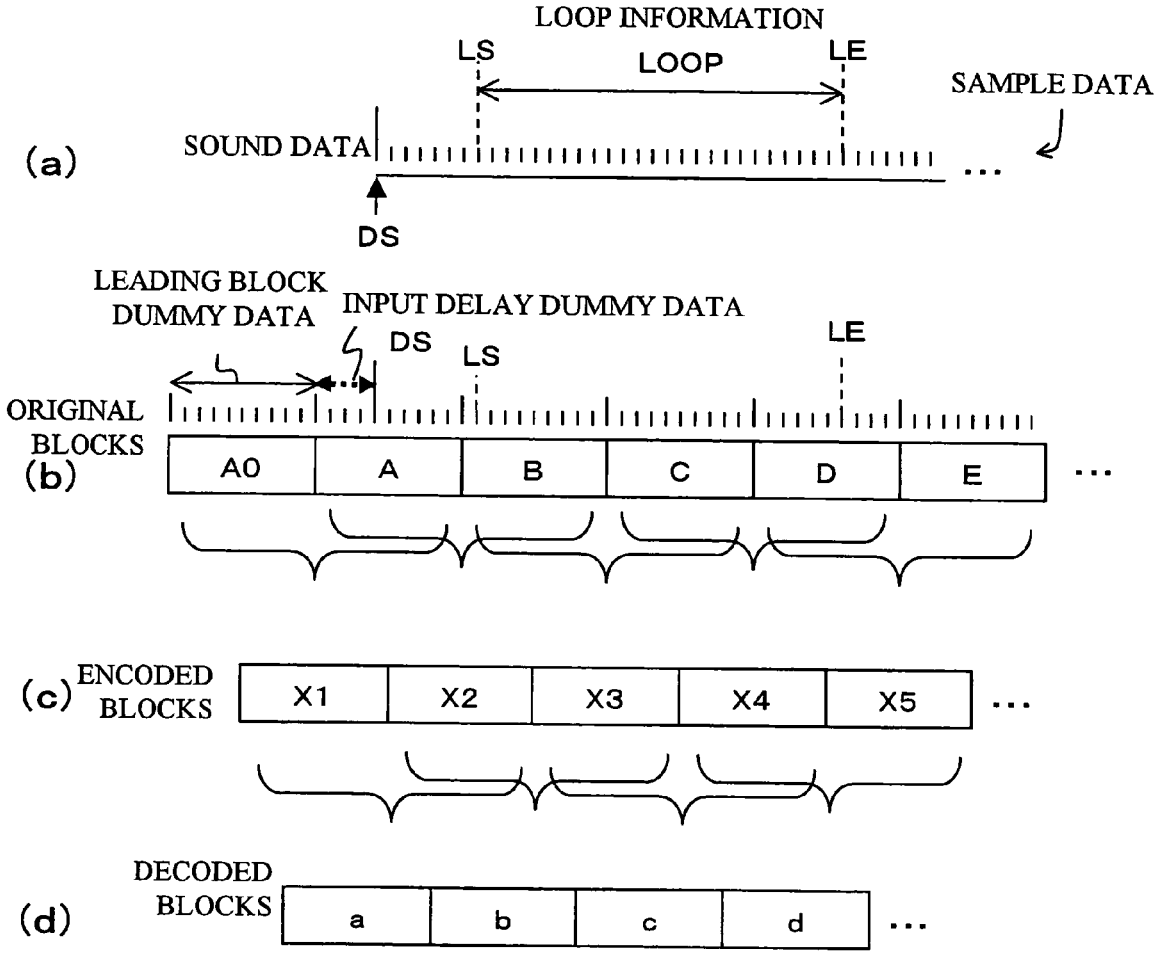
FIG. 9 is a diagram for explaining a method of dividing blocks of sound data 11 in a variational example.

Next, as shown in FIG. 9(*b*), dummy data whose number of samples is the obtained input delay dummy data sample number are added ahead of the sound data 11.

Here, will be considered the case where the number of samples of one block is L and the loop end position becomes the X-th sample ($1<=X<=L$) in the block including the loop end position when the original sound data is divided beginning at its top. Further, it is assumed that the loop end sample condition number is N. In the case where $X>=N$, it is not necessary to redivide the sound data into blocks. On the other hand, in the case where $X<N$, the input delay dummy data are added to the top. The number of samples of the input delay dummy data to be added is $N-X$.

However, when audio codec delay (encoding delay and decoding delay) occurs, the number of samples of the input delay dummy data to be added ahead of the sound data becomes $N-1-(X-1+ED+DD)\ \%\ L$ (% means residue arithmetic). When this expression gives 0 or less as the number of samples of the dummy data, then the sound data 11 are divided and encoded without adding the input delay dummy data.

Next, at ahead of the sound data 11, the encode processing unit 110 adds a block A0 to be paired with the block A at the time of encoding. The block A0 is a block of dummy data (hereinafter, referred to as leading block dummy data). The leading block dummy data are silence data, for example.

Thus-divided sound data are encoded as described above, to obtain encoded data.

Figure 10:
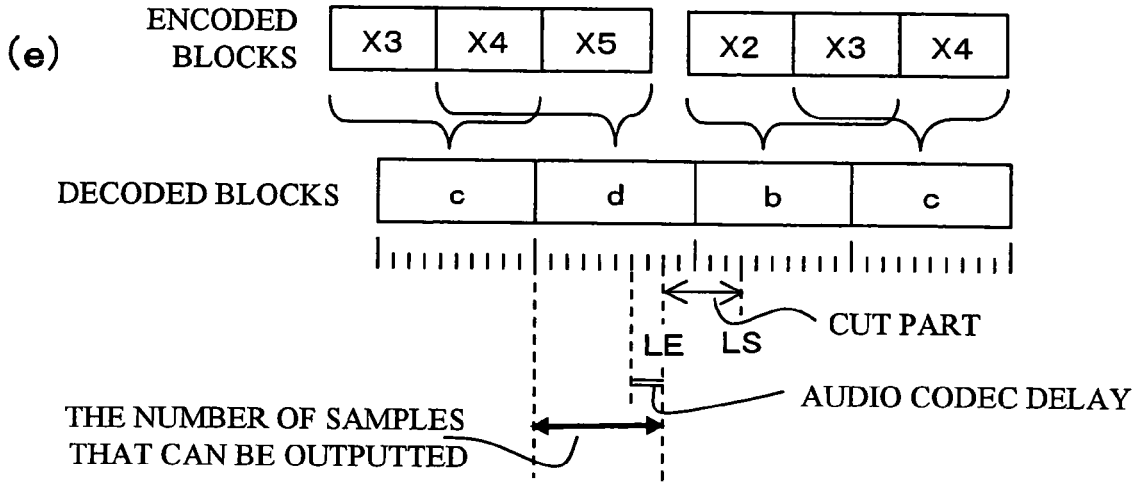
FIG. 10 is a diagram for explaining processing in blocks at the time of looping in a variational example.

FIG. 10 shows playing at the time of looping in thus-obtained encoded data. As shown in the figure, the loop end position LE is not located at the end of the decoded block d. However, the decoded block d includes a sufficient number of samples that can be outputted. As a result, the processing load at the time of looping is reduced.

In the above example, silence data are used as the leading block dummy data. However, the present embodiment is not limited to this. As the leading block dummy data, may be used data that has a correlation with a block to be paired with. Further, similarly to ahead of the sound data, data having a correlation with a block to be paired with may be used as dummy data to be added to the end part (end block dummy data). In that case, it is possible to improve sound quality at the start and end positions of the sound data.

Further, in the case where the start position of the sound data coincides with the loop start position, then, as the leading block dummy data, may be used data that has some degree of continuity with the sound data at the loop start position.

In detail, sound data located just before the loop end position are used as the leading block dummy data. Usually, a piece of music is composed such that the loop end can be smoothly connected to the loop start. Thus, in many cases, sound data at the loop end position has some degree of continuity with sound data at the loop start position.

Figure 11:
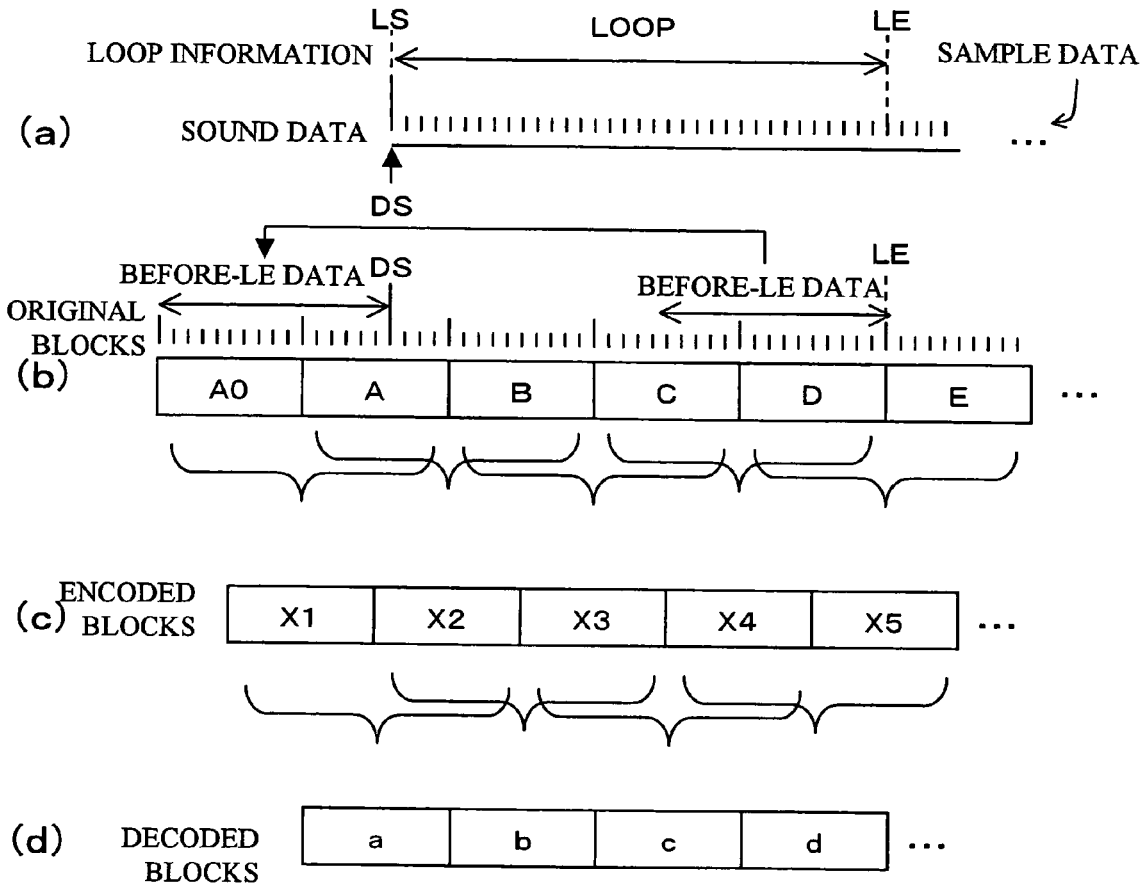
FIG. 11 is a diagram for explaining a method of dividing blocks of sound data 11 in a variational example.

Such a case will be described referring to FIG. 11. In the sound data shown in FIG. 11, the start position of the sound data coincides with the loop start position.

In this case, the encode processing unit 110 divides the sound data as follows, before encoding.

First, as described above, the number of samples of the required input delay dummy data is obtained. Next, the sum of the number of samples of the input delay dummy data and the number of samples of the leading block dummy data (the number of samples corresponding to one block) is obtained. Then, samples of the sound data as many as thus-obtained number are extracted before the loop end. The extracted data are added ahead of the sound data, and then, the sound data are divided into blocks, beginning at ahead (See FIG. 11(*b*)).

Further, in the case where the end position of the sound data coincides with the loop end position, then data having some degree of continuity with the sound data at the loop end position may be used as the end block dummy data.

Figure 12:
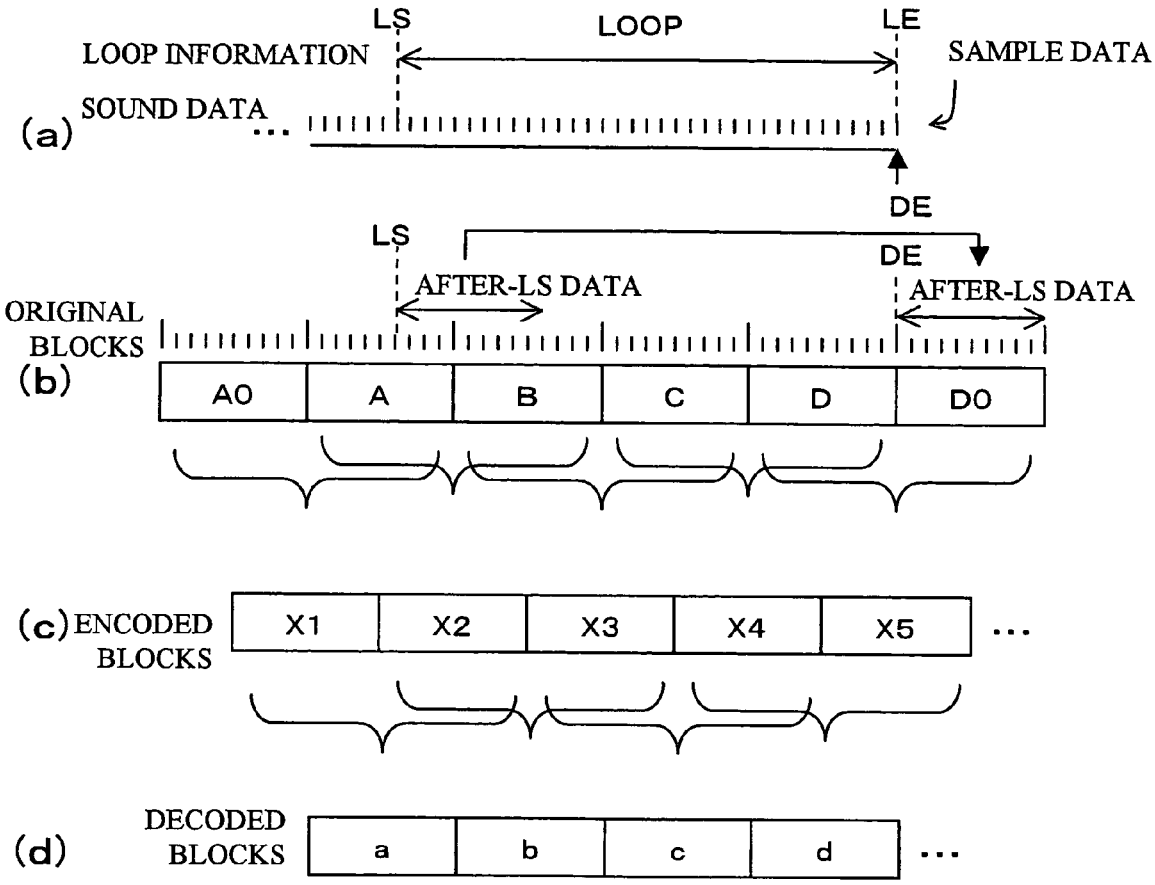
FIG. 12 is a diagram for explaining a method of dividing blocks of sound data 11 in a variational example.

In detail, sound data located just after the loop start position are used as the end block dummy data. Such a case will be described referring to FIG. 12. In the sound data shown in FIG. 12, the end position (DE) of the sound data coincides with the loop end position.

In this case, the encode processing unit 110 divides the sound data as follows, before encoding.

First, as described above, the number of samples of the required end block dummy data is obtained. In the case where the end position of the sound data (i.e., the loop end position) is located at the end of a block, the number of samples of the required dummy data is the number of samples corresponding to one block. Next, samples of the sound data as many as thus-obtained number are extracted after the loop start position. Then, the extracted data are added to the end of the sound data, and then, the sound data are divided into blocks, beginning at ahead.

The above embodiment has been described mainly with respect to the case employing the encoding method in which two consecutive blocks are used to generate one block of encoded data. However, the present invention can be applied also to the case of employing an encoding method in which three or more consecutive original blocks are used to generate one block of encoded data.

Further, the present invention can be applied also to the case of employing a decoding method in which three or more consecutive encoded blocks are used to generate one block of decoded data.

The invention claimed is:

1. A sound data encoding apparatus for encoding sound data, wherein:

said sound data encoding apparatus comprises:

a block dividing means that divides the sound data into blocks; and an encoding means that encodes said blocks in groups of a plurality of consecutive blocks; and in the case where a loop start position and a loop end position are designated with respect to said sound data and said loop start position is a sound start position, then said encoding means encodes said blocks, using sound data samples just before the loop end position as sound data samples before the sound start position.

2. A sound data encoding apparatus for encoding sound data, wherein:

said sound data encoding apparatus comprises:

a block dividing means that divides the sound data into blocks; and an encoding means that encodes said blocks in groups of a plurality of consecutive blocks; and in the case where a loop start position and a loop end position are designated with respect to said sound data and said loop end position is a sound end position, then said encoding means encodes said blocks, using sound data samples just after the loop start position as sound data samples after the sound end position.

3. A sound encoding apparatus for encoding sound data, wherein:

said sound data encoding apparatus comprises:

a block dividing means that divides the sound data into blocks; and an encoding means that encodes said blocks in groups of a plurality of consecutive blocks; and in the case where a part between a sound start position and a sound end position is a loop part of said sound data, then said encoding means encodes said blocks, using sound data samples just before the sound end position as sound data samples just before the sound start position, and sound data samples just after the sound start position as sound data samples just after the sound end position.

4. A sound data decoding apparatus that sequentially reads encoded sound data encoded by a sound data encoding apparatus according to claim 1, and decodes said encoded sound data in groups of a plurality of consecutive blocks.

5. A program store on a computer readable recording medium for making a computer function as a sound data encoding apparatus that encodes sound data, wherein:

said program makes the computer function as a block dividing means that divides the sound data into blocks; and an encoding means that encodes said blocks in groups of a plurality of consecutive blocks; and in the case where a loop start position and a loop end position are designated with respect to said sound data and said loop start position is a sound start position, then said encoding means encodes said blocks, using sound data samples just before the loop end position as sound data samples before the sound start position.

6. A program stored on a computer readable recording medium for making a computer function as a sound data encoding apparatus that encodes sound data, wherein:

said program makes the computer function as a block dividing means that divides the sound data into blocks; and an encoding means that encodes said blocks in groups of a plurality of consecutive blocks; and in the case where a loop start position and a loop end position are designated with respect to said sound data and said loop end position is a sound end position, then said encoding means encodes said blocks, using sound data samples just after the loop start position as sound data samples after the sound end position.

7. A program stored on a computer readable medium for making a computer function as a sound data encoding apparatus that encodes sound data, wherein:

said program makes the computer function as a block dividing means that divides the sound data into blocks; and an encoding means that encodes said blocks in groups of a plurality of consecutive blocks; and in the case where a part between a sound start position and a sound end position is a loop part of said sound data, then said encoding means encodes said blocks, using sound data samples just before the sound end position as sound data samples just before the sound start position, and sound data samples just after the sound start position as sound data samples just after the sound end position.

8. The program stored on a computer readable recording medium for making a computer function as a sound data decoding apparatus that sequentially reads encoded sound data encoded by a sound data encoding apparatus according to claim 1, and decodes said encoded sound data in groups of a plurality of consecutive blocks.

9. A sound data encoding method for a sound data encoding apparatus that encodes sound data, wherein:

said sound data encoding method comprises:

a block dividing step, in which the sound data are divided into blocks; and an encoding step, in which said blocks are encoded in groups of a plurality of consecutive blocks; and in said encoding step, in the case where a loop start position and a loop end position are designated with respect to said sound data and said loop start position is a sound start position, then said blocks are encoded, using sound data samples just before the loop end position as sound data samples before the sound start position.

10. A sound data encoding method for a sound data encoding apparatus that encodes sound data, wherein:

said sound data encoding method comprises:

a block dividing step, in which the sound data are divided into blocks; and an encoding step, in which said blocks are encoded in groups of a plurality of consecutive blocks; and in said encoding step, in the case where a loop start position and a loop end position are designated with respect to said sound data and said loop end position is a sound end position, then said blocks are encoded, using sound data samples just after the loop start position as sound data samples after the sound end position.

11. A sound data encoding method for a sound data encoding apparatus that encodes sound data, wherein:

said sound data encoding method comprises:

a block dividing step, in which the sound data are divided into blocks; and an encoding step, in which said blocks are encoded in groups of a plurality of consecutive blocks; and in said encoding step, in the case where a part between a sound start position and a sound end position is a loop part of said sound data, then said blocks are encoded, using sound data samples just before the sound end position as sound data samples just before the sound start position, and sound data samples just after the sound start position as sound data samples just after the sound end position.

12. A sound data decoding method, wherein: encoded sound data encoded by a sound data encoding method according to claim 9 are sequentially read, and said encoded sound data are decoded in groups of a plurality of consecutive blocks.

* * * * *